US009782006B2

(12) United States Patent
Arruda et al.

(10) Patent No.: US 9,782,006 B2
(45) Date of Patent: Oct. 10, 2017

(54) COLLAPSIBLE ROCKING CHAIR

(71) Applicant: Recreational Equipment, Inc., Kent, WA (US)

(72) Inventors: Jon Arruda, Tacoma, WA (US); Steve Nagode, Federal Way, WA (US); Nasahn Adam Sheppard, Mercer Island, WA (US)

(73) Assignee: RECREATIONAL EQUIPMENT, INC., Kent, WA (US)

( * ) Notice: Subject to any disclaimer, the term of this patent is extended or adjusted under 35 U.S.C. 154(b) by 0 days.

(21) Appl. No.: 14/727,635

(22) Filed: Jun. 1, 2015

(65) Prior Publication Data

US 2016/0345738 A1 Dec. 1, 2016

(51) Int. Cl.

| | |
|---|---|
| ***A47C 7/00*** | (2006.01) |
| ***A47C 4/02*** | (2006.01) |
| ***A47C 3/029*** | (2006.01) |
| ***A47C 4/28*** | (2006.01) |
| ***A47C 4/52*** | (2006.01) |

(52) U.S. Cl.

CPC ..... *A47C 4/021* (2013.01); *A47C 3/029* (2013.01); *A47C 4/02* (2013.01); *A47C 4/28* (2013.01); *A47C 4/52* (2013.01)

(58) Field of Classification Search

CPC ..... A47C 4/022; A47C 4/30; A47C 3/029

USPC ..... 297/440.11, 440.13, 258.1, 270.1, 270.5, 297/271.6

See application file for complete search history.

(56) References Cited

U.S. PATENT DOCUMENTS

| | | | | | |
|---|---|---|---|---|---|
| 3,114,572 | A | * | 12/1963 | Hopkins | A47C 3/029 297/133 |
| 4,126,353 | A | * | 11/1978 | Clough | A47C 13/00 297/133 |
| 4,285,543 | A | * | 8/1981 | Clark | A47C 3/029 297/133 |
| 4,605,261 | A | * | 8/1986 | Lee | A47C 4/286 297/16.1 |

(Continued)

FOREIGN PATENT DOCUMENTS

WO WO2013/180831 A1 12/2013

OTHER PUBLICATIONS

Author Unknown, "ALPS Mountaineering Freedom Chair—Special Buy," Available at: http://www.rei.com/product/883263/alps-mountaineering-freedom-cha ir-special-buy, 1 page (printed May 13, 2015).

(Continued)

*Primary Examiner* — Timothy J Brindley

(74) *Attorney, Agent, or Firm* — K&L Gates LLP

(57) ABSTRACT

Disclosed herein are portable, collapsible rocking chairs for outdoor use. These rocking chairs have a plurality of chair arms (each chair arm having a proximal end and a distal end), a removable seat coupled to and supported by the distal ends of the plurality of chair arms, and a rocker assembly for rocking. An exemplary rocker assembly includes two rocker rails, one or more cross bars coupled to the rocker rails, and a plurality of arm ports for removably receiving the proximal end of each chair arm. Some rocker assemblies also include one or more hubs coupled to each rocker rail. The chair arms may comprise one or more hollow pole segments and an elastic cord coupling the pole segments and the rocker assembly.

19 Claims, 8 Drawing Sheets

(56) References Cited

U.S. PATENT DOCUMENTS

| | | | | | |
|---|---|---|---|---|---|
| 4,807,926 | A * | 2/1989 | Brunn | A47C 4/12 | 297/131 |
| 5,678,890 | A * | 10/1997 | Tenbroeck | A47C 5/12 | 297/271.6 |
| 5,709,428 | A * | 1/1998 | Hugghins | A47C 4/283 | 135/127 |
| 6,257,660 | B1 * | 7/2001 | Calvey | A47C 4/38 | 297/16.1 |
| 6,398,297 | B1 * | 6/2002 | Cantwell | A47C 4/286 | 297/133 |
| 6,439,656 | B1 * | 8/2002 | Liu | A47C 3/029 | 297/271.6 |
| D523,649 | S * | 6/2006 | Sanford-Schwentke | D6/348 | |
| 7,100,975 | B1 * | 9/2006 | Zheng | A47C 4/286 | 297/271.6 |
| 7,137,351 | B2 * | 11/2006 | Picou | B63B 29/04 | 114/363 |
| 8,205,934 | B2 * | 6/2012 | Homans | A47C 4/02 | 297/16.1 |
| 8,454,084 | B2 * | 6/2013 | Lah | A47C 9/105 | 297/16.2 |
| 8,899,686 | B1 * | 12/2014 | Kim | A47C 4/02 | 297/16.1 |
| D746,091 | S * | 12/2015 | Chen | D6/385 | |
| 9,326,612 | B2 * | 5/2016 | Kim | A47C 4/022 | |
| 2003/0222484 | A1 * | 12/2003 | Gette | A47C 7/66 | 297/16.2 |
| 2011/0148162 | A1 * | 6/2011 | Huang | A47C 3/029 | 297/271.6 |
| 2015/0091335 | A1 * | 4/2015 | Lee | A47C 3/18 | 297/16.1 |
| 2016/0113402 | A1 * | 4/2016 | Lee | A47C 4/42 | 297/16.2 |

OTHER PUBLICATIONS

Author Unknown, "Freestyle Rocker," Available at: http://www.rei.com/zoom/mm/212ab2da-8941-48a7-9221-26a3b1c70379.jpg/440, 1 page (May 13, 2015).

Author Unknown, "Freestyle Rocker," Available at: http://www.rei.com/zoom/uu/b1ecf01e-21e4-4d3f-93c8-93c6fa764dfa.jpg/440,1 page (printed May 13, 2015).

Author Unknown, "Freestyle Rocker," Available at: http://www.rei.com/zoom/vv/7cef1c67-aaae-48b6-9d56-b53affee8a2f.jpg/440,1 page (printed May 13, 2015).

Author Unknown, "GCI Outdoor Freestyle Rocker Chair," Available at: http://www.rei.com/product/853186/gci-outdoor-freestyle-rocker-chair , 1 page (printed May 13, 2015).

Author Unknown, "L.L. Bean Camp Comfort Rocker," Available at: http://www.llbean.com/llb/shop/80878?page=llbean-camp-comfort-rocker, 2 pages (printed May 13, 2015).

Author Unknown, "Low Rider Camp Rocker," Available at: http://www.llbean.com/llb/shop/80881?feat=80878-pprrtop, 2 pages (printed May 13, 2015).

* cited by examiner

COLLAPSIBLE ROCKING CHAIR

FIELD OF THE INVENTION

The embodiments disclosed herein relate to collapsible chairs for compact storage and transportation.

BACKGROUND

The increasing popularity of outdoor recreational activities continues to broaden the demand for all types of portable, compact furniture. In particular, portable and compact furniture is not only in high demand by seasoned outdoor enthusiasts but is also desired for recreational activities such as casual camping, spectator sports, and fishing. Nonetheless, most existing portable, outdoor furniture usually falls into one of two categories: (1) ultra-lightweight, compact furniture designed for backpacking, which typically compromises comfort for reduced size and weight and often requires complex set up; or (2) more sturdy, comfortable furniture that may be portable, but is not particularly lightweight or well suited for storage.

Traditionally, rocking chairs are used to relax in a soothing and comfortable home environment. As casual camping and relaxed outdoor pursuits become more common, several configurations of folding rocking chairs have been designed to enable users to transport traditional rocking chairs to campsites, parks, sports events, concerts, and other outdoor arenas. Although folding chairs are generally easier to transport than traditional, non-folding furniture, the existing folding rocking chairs are particularly cumbersome and awkward. This is in part because the rocker rails are typically large and their length and curvature is ill-suited for folding. In addition, rocker rails on folding chairs require additional hinges and add weight. Accordingly, the available configurations of outdoor, portable rocking chairs are not particularly convenient nor are they well-suited for compact storage and transportation.

Conversely, lightweight, easy-to-use, compact camping chairs do not have the appeal or serve the same function as a traditional rocking chair around a campfire. Not only are there no existing configurations of these lightweight chairs that facilitate rocking, but because these chairs often sacrifice comfort, ruggedness, and ease-of-use for size and weight, adding rocking rails to such ultra-lightweight chairs is an unappealing alternative for casual campers, sports spectators, and other users.

Consequently there is a need and a demand for configurations of portable rocking chairs that are both comfortable and sturdy but are also compact and light-weight enough to be transported to a variety of locations and events and easily stored while not in use.

SUMMARY

Exemplary embodiments described herein provide for collapsible rocking chairs, comprising: a plurality of chair arms that each have a proximal end and a distal end; a seat that is removably coupled to and supported by the distal ends of the plurality of chair arms; and a rocker assembly for supporting the chair arms and seat, and enabling a rocking motion of the chair.

Each rocker assembly includes, without limitation, a first rocker rail and a second rocker rail, one or more cross bars coupled to the rocker rails, and a plurality of arm ports, each of which can removably receive the proximal end of a chair arm. In some embodiments, the rocker assembly also comprises a first hub and a second hub, with arm ports of the rocker assembly being located on these hubs and each hub being coupled to one of the rocker rails. The hubs in certain configurations are coupled to the one or more cross bars. In configurations with two cross bars, each of the first hub and the second hub include two cross bar ports for removably receiving one end of one or more cross bars. In certain embodiments the rocker assembly also comprises at least one threaded rod located within and running the length of each cross bar. Each threaded rod is received into a fastener on the first rocker rail and on the second rocker rail. Each threaded rod is couplable to both rocker rails. In some embodiments, each rocker rail has a curved arc front portion and a flat tail portion for stopping.

Certain configurations of the rocking chair have two back-supporting arms and two seat-supporting arms, where the back-supporting arms are longer than the seat-supporting arms. In some embodiments the distance between the distal ends of the back-supporting arms is less than the distance between the distal ends of the seat-supporting arms. The distance between the distal end of a back-supporting arm and the distal end of the seat-supporting arm on the same side of the chair (i.e., where both the back-supporting arm and the seat-supporting arm are coupled to the same rocker rail) is, in certain configurations, greater than distance between the proximal ends of those two chair arms.

Each chair arm of the exemplary embodiments described herein comprises at least one hollow pole segment and an elastic cord that runs through each hollow pole segment. In one embodiment the first end of the elastic cord terminates within one of the arm ports of the rocker assembly and the second end terminates at the distal end of the chair arm receivable in that arm port. In a different embodiment, the first end of the elastic cord terminates at the distal end of one chair arm and the second end terminates at the distal end of a second chair arm which is coupled to the same rocker rail. In rocking chair configurations where each chair arm comprises a plurality of hollow pole segments, these segments are removably coupled to each other via the elastic cord.

The seat of rocking chair includes pockets for removably receiving the distal ends of the chair arms that support the seat. In some embodiments, the seat is comprised of two fabric panels. The fabric seat of one described embodiment is hammock-shaped. The length of the seat measured between the midpoint between the distal ends of two back-supporting arms of the rocking chair and the midpoint between the distal ends of two seat-supporting arms is greater than length of the seat measured between the distal end of the back-supporting arm and the distal end of the seat-supporting arm on at either side of the seat. (i.e., where both the back-supporting arm and the seat-supporting arm are coupled to the same rocker rail).

One embodiment of a rocking chair described herein is contained within a bag, satchel, a backpack, or a tote.

BRIEF DESCRIPTION OF THE DRAWINGS

FIG. 4A illustrates an elastic cord terminating within the hub. FIG. 4B illustrates an elastic cord extending through the hub from one chair arm to another chair arm. FIG. 4C illustrates an elastic cord extending through the hub from a chair arm to a cross bar.

DETAILED DESCRIPTION

Various configurations of rocking chairs described herein are collapsible and allow for compact transportation and storage without sacrificing comfort. These embodiments may overcome the limitations of existing folding rocking chairs and also go beyond the mere addition of rocking rails to the lightweight camping chairs.

Figure 1:
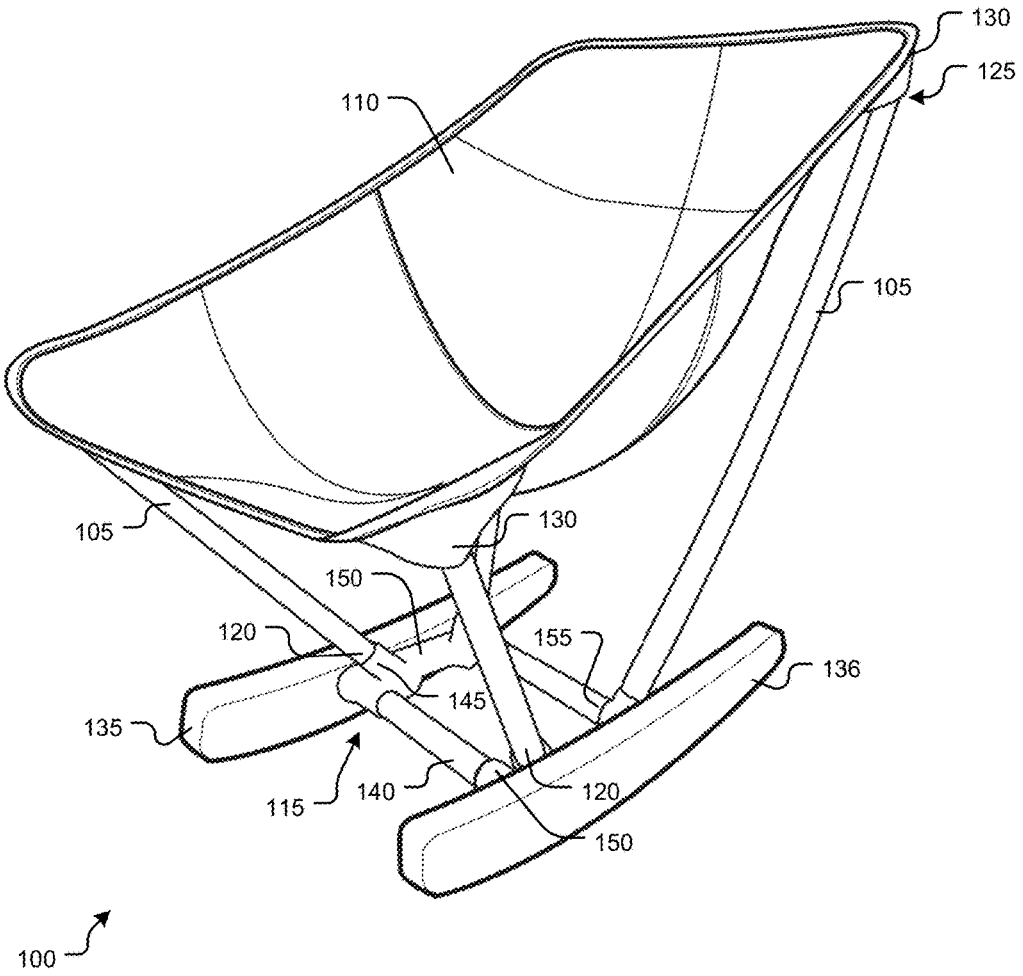
FIG. 1 is a front perspective view of a rocking chair, in accordance with embodiments of the present invention.

FIG. 1 illustrates an exemplary embodiment of a disclosed rocking chair 100 from a front perspective view. This configuration includes a rocker assembly 115, and a plurality of chair arms 105 which support removable seat 110. Chair arms 105 each have a proximal end 120 coupled to rocker assembly 115 and a distal end 125 removably received into pockets 130 of seat 110. In one embodiment, seat 110 is supported by four chair arms 105, but in other embodiments, the seat may be supported by fewer or greater chair arms, e.g., five, six, or more chair arms.

Rocker assembly 115 comprises two rocker rails 135, 136 with each rocker rail removably coupled to proximal ends 120 of one or more chair arms 105. Proximal ends 120 are removably received in arm ports 145 of rocker assembly 115. Chair arms 105 can each extend radially out from rocker assembly 115 to support seat 110. Alternatively, in other embodiments, two chair arms 105 extend at an angle to cross one another to form an x-shape, which is held in place by a clip or equivalent attaching mechanism holding the chair arms together at the center of the x.

In some exemplary embodiments, rocker assembly 115 comprises at least one cross bar 140 coupling rocker rails 135 and 136 to each other. Certain configurations of rocker assembly 115 have one cross bar 140, other configurations have two cross bars 140, and still other configurations have three or more cross bars. Each end of each cross bar is received into a cross bar port 155 of rocker assembly 115. The number of cross bar ports 155 of rocker assembly 115 is double the number of cross bars. Some rocker assemblies have cross bars fixed to each cross bar port; in others, the ends of the one or more cross bar(s) are removably coupled in the cross bar ports.

Certain configurations of rocker assembly 115 also include one or more hubs 150 attached to rocker rail 135 and rocker rail 136. Some embodiments have one hub attached to each rocker rail; other embodiments have two or more hubs attached to each rocker rail. In rocking chairs of the present description that include hubs 150, the hubs are coupled to the rocker rails and the one or more cross bar is coupled to each hub. Cross bar ports 155 are located on each hub 150. Certain rocker assemblies with hubs also have arm ports 145 formed in the hubs 150 (instead of in the rocker rails). For example, in one exemplary embodiment, rocker rail 135 is coupled to hub 150 which comprises two arm ports 145 and one or more cross bar ports 155.

Figure 2:
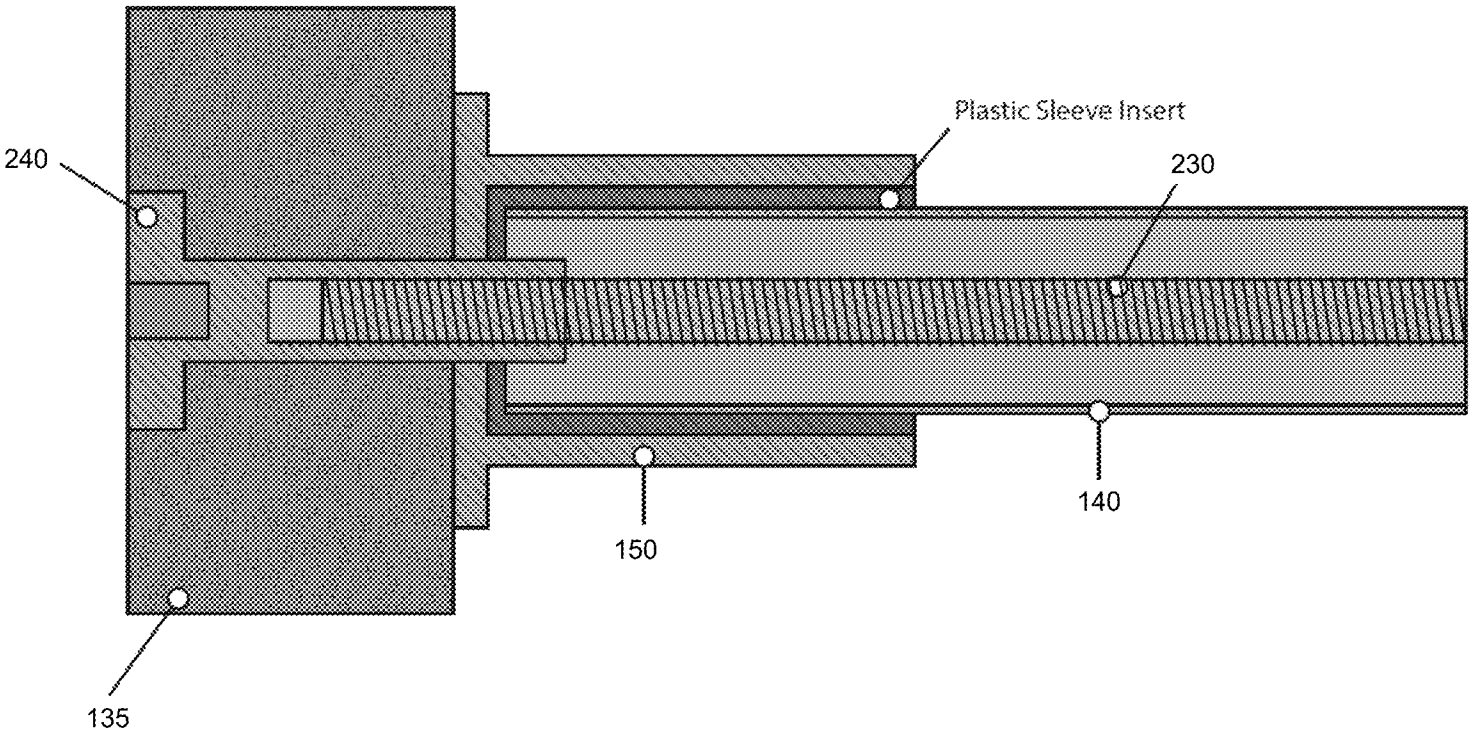
FIG. 2 is a cross-sectional view of an embodiment of a rocker assembly depicting a rocker rail, a hub, a cross bar, and a threaded rod coupling the cross bar to the rocker rail, in accordance with embodiments of the present invention.

The one or more cross bars of a rocker assembly of the present description can be coupled to the rocker rails and/or hubs by various methods and mechanisms, including without limitation, glue, tension, one or more fasteners, one or more threaded rods, or one or more elastic cords. In one embodiments, the one or more cross bars are removably received into the cross bar port(s) of each rocker rail and coupled to the hub or rocker rail by an elastic cord located within and running the length of each cross bar. In another embodiment, the one or more cross bar(s) are coupled to a rocker rail by the exemplary configuration shown in FIG. 2, which shows a cross-sectional view of rocker rail 135, hub 150, and cross bar 140. In the embodiment illustrated in FIG. 2, cross bar 140 comprises a hollow tube of aluminum or another suitably rigid material, including without limitation, steel, vinyl, or plastic. At least one threaded rod 230 is located within hollow cross bar 140 and coupled to rocker rail 135. In one embodiment, threaded rod 230 screws into fastener 240 positioned in an opening in rocker rail 135 thereby coupling cross bar 140 and hub 150 to rocker rail 135. In some embodiments threaded rod 230 runs the full length of cross bar 140 and each end of threaded rod 230 is received into a fastener 240 on the rocker rails on each side of the rocker assembly. In another embodiment there is a separate threaded rod located on either end of cross bar 140, the first threaded rod coupling cross bar 140 and hub 150 to rocker rail 135 and the second threaded rod coupling cross bar 140 to a second hub and second rocker rail of the rocker assembly.

Figure 3:
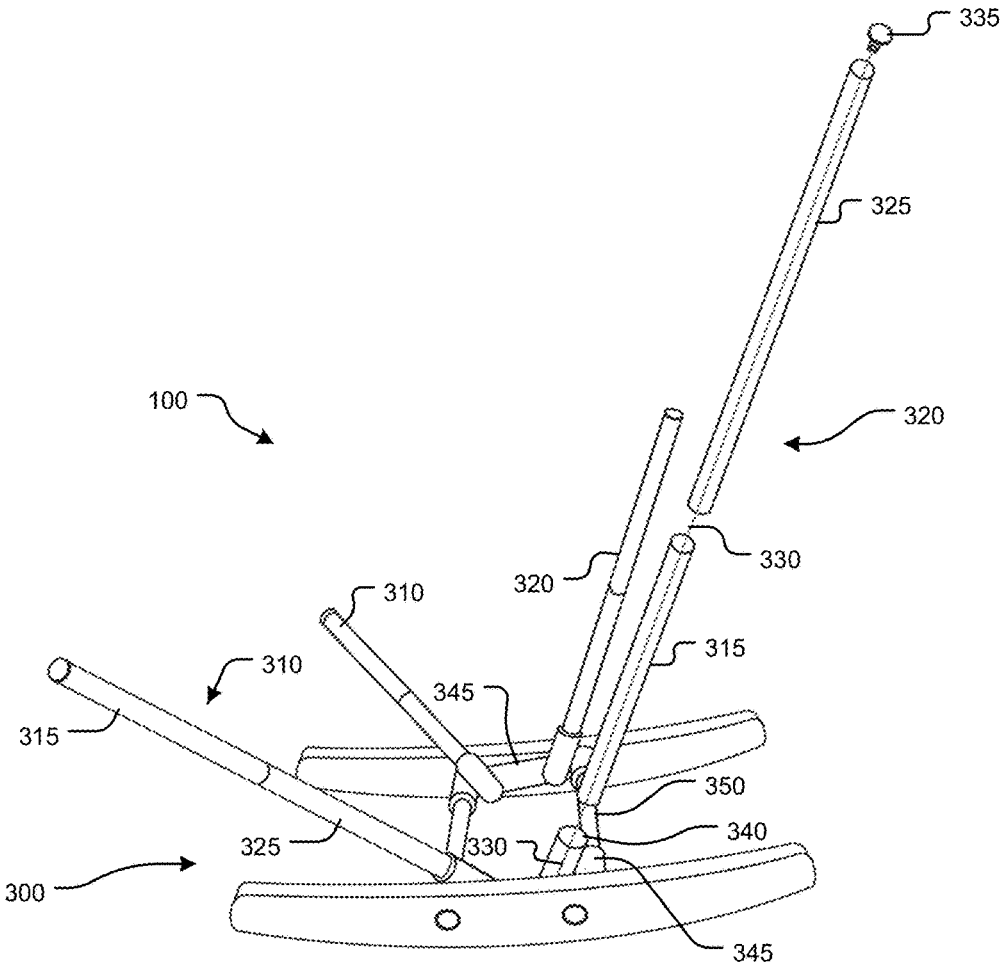
FIG. 3 is a left side elevation view of a rocker assembly and chair arms illustrating the structural elements and features thereof, in accordance with embodiments of the present invention.
Figure 8A:
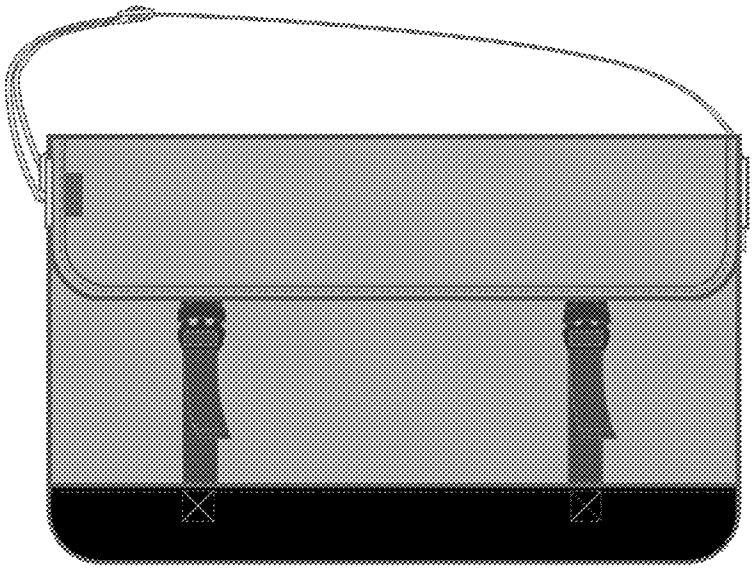
FIGS. 8A-8C are views of a tote bag for carrying a collapsed rocking chair, in accordance with embodiments of the present invention.
Figure 8B:
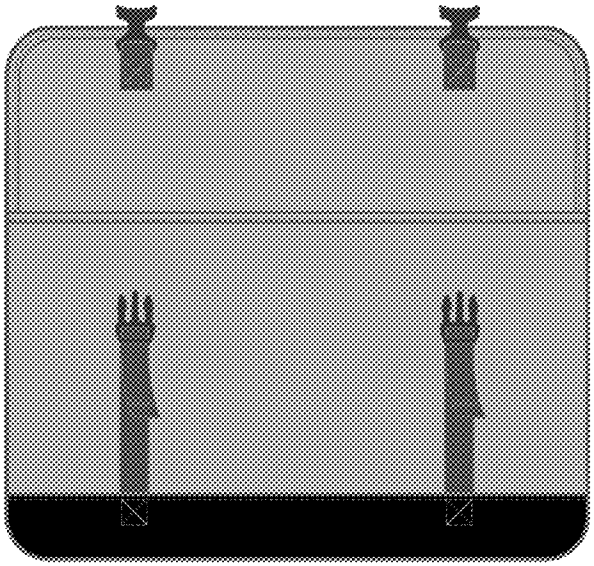
Figure 8C:
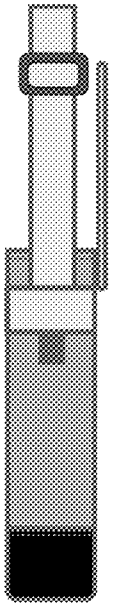

Similarly, the chair arms of certain embodiments are removably coupled to the rocker assembly via an elastic cord. FIG. 3 depicts a left side elevation view of a collapsible rocking chair, wherein the seat is removed and rocker assembly 300 is removably coupled to chair arms 310, 320 via elastic cord 330. Chair arm 320 is shown in exploded view to expose the elastic cord 330 contained therein. When the seat is removed from the chair arms 310, 320, the seat can be folded for compact and easy storage and transportation. In addition, chair arms 310 and 320 can be uncoupled from the rocker assembly 300. In embodiments where chair arms 310 and 320 each comprise more than one pole segment 315, 325, as shown in FIG. 3, these pole segments 315, 325 can also be uncoupled from each other. In certain embodiments, hubs 345 can also be uncoupled from cross bars 350 and/or the rocker rails. When certain exemplary rocking chairs of the present description are collapsed, all the component parts (including without limitation, the seat, chair arms, and rocker assembly) may be contained in a bag for convenient storage and transportation, including without limitation, a satchel, a backpack, a kit bag, or a tote. An exemplary tote bag 800 for transporting the collapsed rocking chair is shown in FIGS. 8A-8C.

FIG. 3 shows a first end of elastic cord 330 received in arm port 340 such that the proximal end of chair arm 320 is removably coupled to rocker assembly 300 by the elastic cord 330, and the proximal end of chair arm 320 is received in arm port 340. Chair arms 310, 320 comprise at least one hollow pole segment 315 containing elastic cord 330. In some configurations where arm port 340 is located on hub 345, the first end of elastic cord 330 terminates in hub 345.

In other configurations, the first end of elastic cord 330 terminates in arm port 340 on the rocker rail. The second end of elastic cord 330 terminates at the distal end of chair arm 320. In one embodiment, the second end of elastic cord 330 terminates at cap 335, which seals off the hollow pole segment(s) of chair arm 320. In some embodiments, chair arms 310, 320 are comprised of two hollow pole segments 315, 325. Other embodiments have chair arms each comprised of more than two hollow pole segments.

Pole segments 315 and 325 are also removably couplable to each other via elastic cord 330. Pole segments 315, 325 can be pulled apart so that a disclosed rocking chair can be collapsed into a more compact and portable configuration. Similarly pole segment 315 can be removed from arm port 340 to collapse a rocking chair of the present description. When the pole segments are collapsed, elastic cord 330 maintains a connection between the pole segments and rocker assembly 300. Accordingly, elastic cord 330 helps prevent pole segments 315, 325 from getting separated from one another or from arm port 340 or getting lost when a collapsed rocking chair is being stored or transported. In addition, elastic cord 330 enables a rocking chair to be reconstructed quickly and efficiently because the correct ends of pole segments 315, 325 of chair arm 320 are already linked to one another and to rocker assembly 300 via elastic cord 330.

FIG. 3 illustrates an exemplary rocking chair of the present description comprising two seat-supporting arms 310 and two back-supporting arms 320. In some exemplary configurations, back supporting arms 320 are longer than seat supporting arms 310.

Figure 4A:
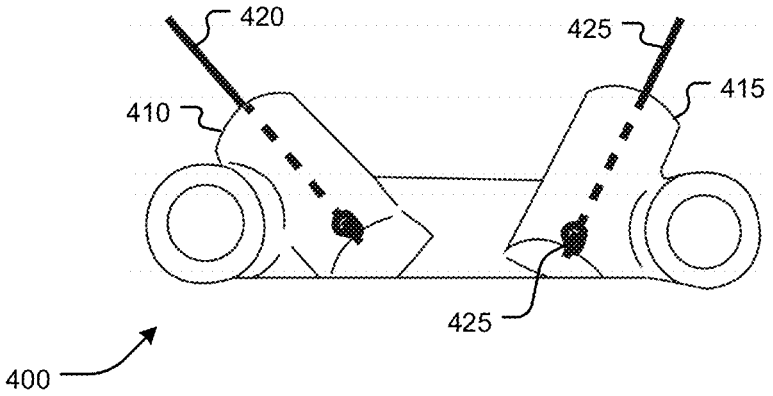
FIGS. 4A-4C provide three cross-sectional views of an exemplary hub, each illustrating a different embodiment of the elastic cord of a chair arm, in accordance with embodiments of the present invention.
Figure 4B:
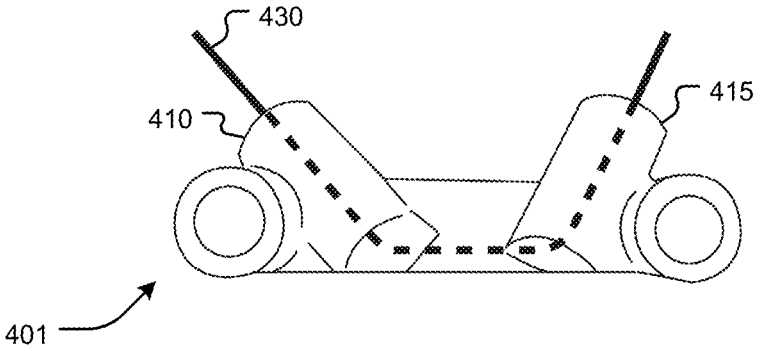
Figure 4C:
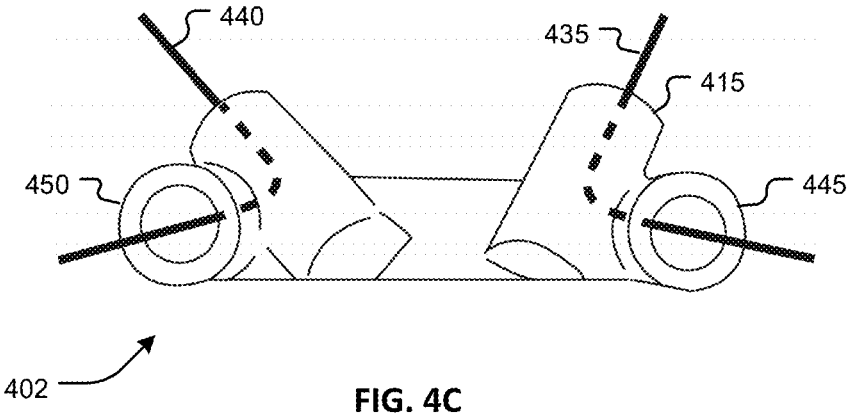

FIGS. 4A-4C depict three cross-sectional views of exemplary hubs, with each cross-section illustrating a different embodiment of an elastic cord coupling the chair arms to the rocker assembly. FIG. 4A illustrates arm ports 410, 415 of hub 400, with elastic cords 420, 425 both terminating within hub 400. Rocking chairs of this illustrated embodiment have a seat-supporting arm that is removably couplable to hub 400 in arm port 410 via elastic cord 420, where elastic cord 420 runs through one or more hollow pole segments of the chair arm. Similarly, elastic cord 425 facilitates coupling of the one or more pole segments of a back-supporting arm to hub 400. In configurations where the seat-supporting and/or back-supporting chair arms each have more than one pole segment, elastic cords 420, 425 facilitate easy collapsing and coupling of the pole segments. Elastic cords 420, 425 each terminate within hub 400, with the first end of elastic cord 420, 425 secured to the hub, a fastener, or a washer by a knot and the second end of elastic cord 420, 425 secured at the distal end of the chair arm to an end cap, a fastener, or a washer by a knot. In other embodiments, elastic cord 420, 425 is molded to a component of the hub, the rocker rail, a fastener or a washer at the first end and to an end cap, a fastener, or a washer at the second end.

FIG. 4B illustrates a different configuration of a hub of the present description, in which elastic cord 430 is a single cord extending through hub 401 and through the hollow pole segments of a first seat-supporting arm receivable in arm port 410 and a first back-supporting chair receivable in arm port 415. Elastic cord 430 thereby facilitates convenient coupling and collapsing of the pole segments of two chair arms to one another and a rocker assembly of the present description.

In yet another exemplary embodiment shown in FIG. 4C, elastic cords 440, 435 facilitate coupling of the pole segment (s) of the chair arms and the one or more cross bars to each other and to exemplary hub 402. This configuration allows for convenient collapsing and coupling of the one or more cross bars as well as the pole segment(s) of the chair arms. For example, a first seat-supporting arm, the proximal end of which is receivable in arm port 410, is coupled to hub 402 and a cross bar received in cross bar port 450 via elastic cord 440. In a different configuration, elastic cord 440 runs through (and can couple) a first seat-supporting arm receivable in arm port 410 of first hub 402, a cross bar receivable on one end in cross bar port 450, and a second hub and second seat-supporting arm. In another configuration, elastic cord 435 runs through (and can couple) a first back-supporting chair arm receivable in arm port 415 of first hub 402, a cross bar receivable on one end in cross bar port 445, and a second hub and second back-supporting arm. In yet another embodiment, elastic cord 440 runs through (and can couple) a first seat-supporting chair arm receivable in arm port 410 of first hub 402, a cross bar receivable on one end in cross bar port 450 or cross bar port 445, and a second hub and a second back-supporting chair arm.

Figure 5:
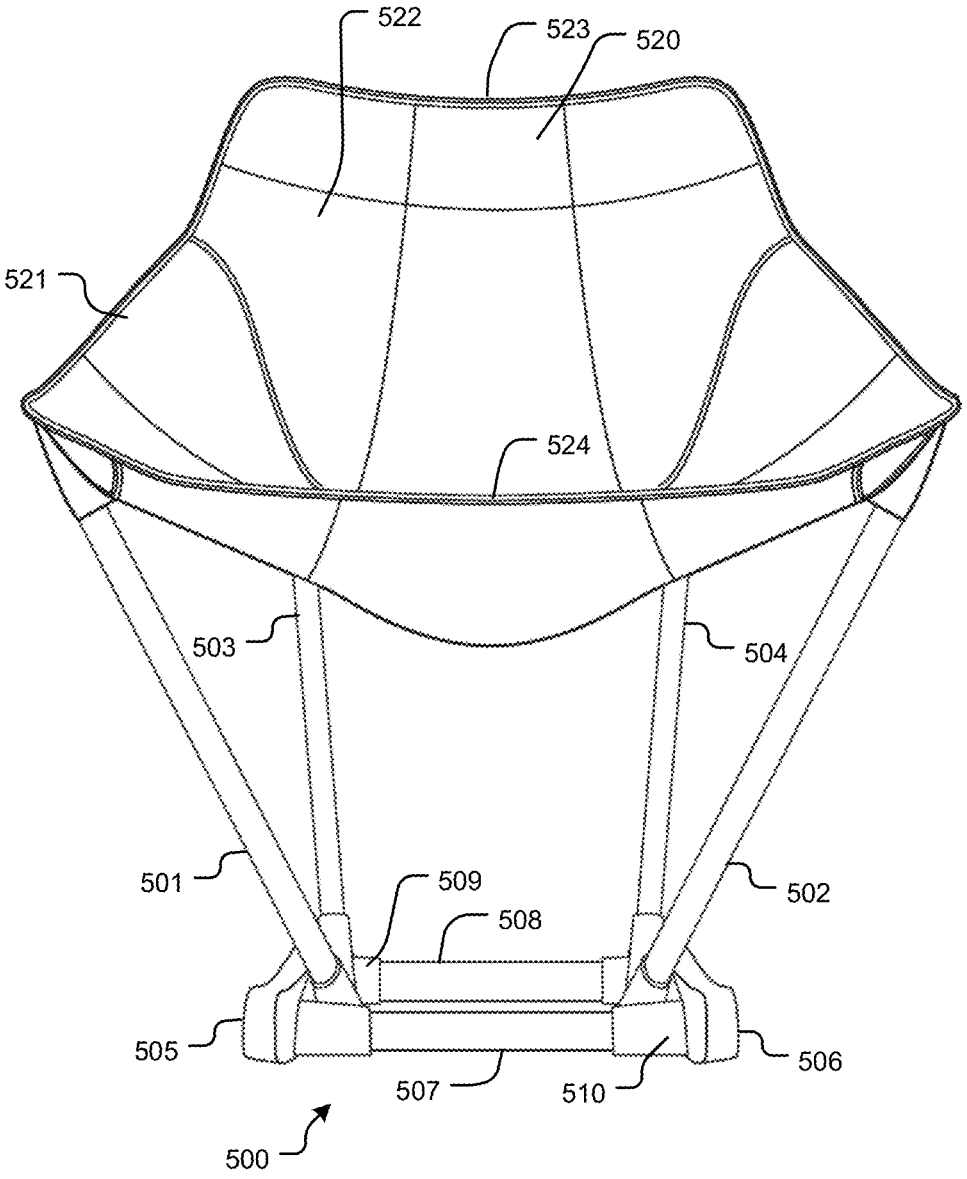
FIG. 5 is a front elevation view of an embodiment of a rocking chair, in accordance with embodiments of the present invention.

FIG. 5 is a front elevation view of rocking chair 500 of the present description. As shown, exemplary rocking chair 500 comprises: two seat-supporting arms 501, 502; two back-supporting arms 503, 504; left rocker rail 505 coupled to hub 509 and the first ends of cross bars 507, 508; right rocker rail 506 coupled to hub 510 and the second ends of cross bars, 507, 508; and, seat 520. In certain rocking chairs of the present description the distance measured between the distal end of back-supporting arm 503 and the distal end of back-supporting arm 504 (i.e., "back width"), is less than the distance measured between the distal end of seat-supporting arm 501 and the distal end of seat-supporting arm 502 (i.e., "front width").

Seat 520 is removably coupled to and supported by the distal ends of seat supporting arms 501, 502 and of back supporting arms 503, 504. In certain embodiments, seat 520 is comprised of fabric, including without limitation canvas, cotton, nylon, polyester, or other synthetic materials. In one embodiment, seat 520 is comprised of two panels, for example, seat supporting panel 521 and back-supporting panel 522. In different embodiments, seat 520 is comprised of a left panel and a right panel.

Some exemplary embodiments of seat 520 have a hammock shape, which is designed for comfortable sitting and rocking. In these embodiments, the length of seat 520 measured from the midpoint (523) between the distal ends of back-supporting arms 503, 504 to the midpoint (524) between the distal ends of seat supporting arms 501, 502 is greater than the length of seat 520 measured between the distal end of back-supporting arm 503 and the distal end of seat-supporting arm 501.

Figure 6:
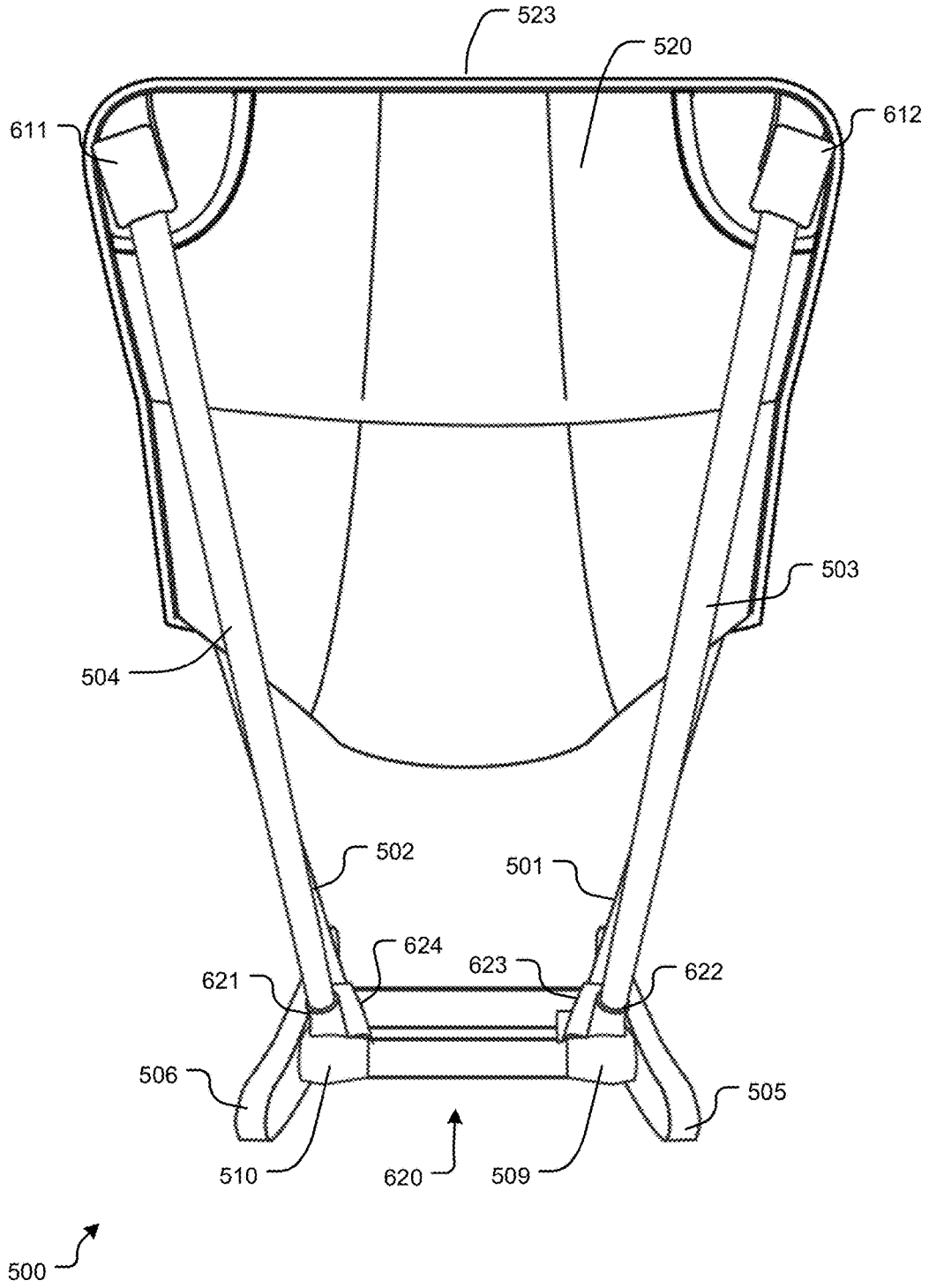
FIG. 6 is a back elevation view of an embodiment of a rocking chair, in accordance with embodiments of the present invention.

FIG. 6 is a back elevation view of rocking chair 500. Back-supporting arms 503, 504 support and are removably coupled to seat 520. More specifically the distal end of chair arm 503 is removably received in pocket 612 on seat 520 and the distal end of chair arm 504 is removably received in pocket 611 on seat 520. The proximal end of chair arm 503 is removably received in arm port 622 of rocker assembly 620 and the proximal end of chair arm 504 is removably received in arm port 621 of rocker assembly 620. Similarly, the proximal ends of front-supporting arms 501, 502 are removably received in arm ports 623, 624, respectively.

In some configurations, arm ports 621, 622 are on rocker rails 506, 505 of rocker assembly 620; in other configurations arm ports 621, 622 are on one or more hubs each coupled to rocker rails 506, 505. In certain rocking chairs of the present description the distance measured between the distal ends of chair arms 503, 504 (i.e., "back distal width")

is greater than the distance measured between the proximal ends chair arms 503, 504 (i.e., "back proximal width"). In one embodiment the width measured between the proximal ends of seat-supporting chair arms (i.e., "front proximal width") is substantially the same as the back proximal width, but the width measured between the distal ends of seat-supporting chair arms (i.e., "front distal width") may be shorter than, the same as, or longer than the back distal width.

Figure 7:
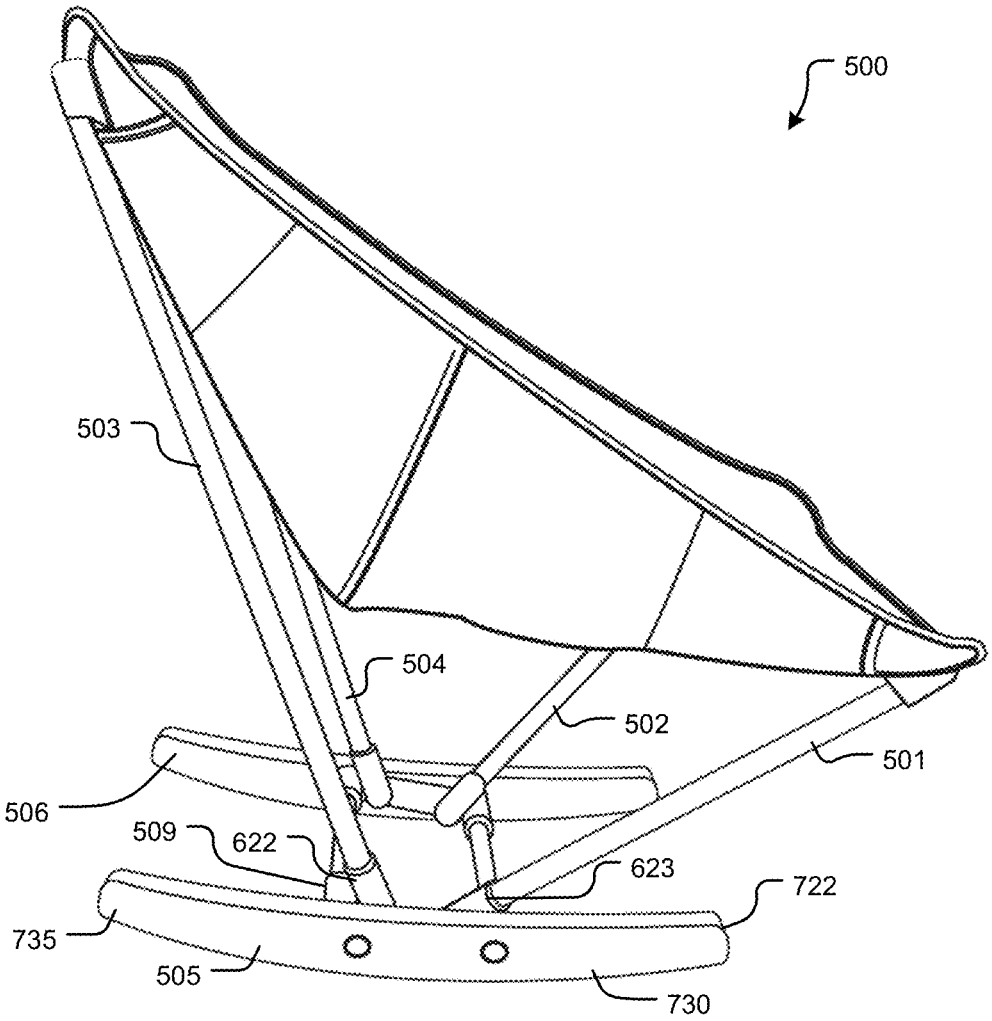
FIG. 7 is a right side elevation view of an embodiment of a rocking chair, in accordance with embodiments of the present invention.

FIG. 7 is a right side elevation view of rocking chair 500 showing rocker rails 505, 506 coupled to back-supporting arms 504, 503 and seat-supporting arms 501, 502. First rocker rail 505 is couplable to hub 509 which comprises arm ports 622, 623. Arm port 622 removably receives the proximal end of back-supporting arm 503 and arm port 623 removably receives the proximal end of seat-supporting arm 501. As shown in FIG. 7 arm ports 622, 623 are located on hub 509, but in other embodiments the arm ports may be directly on rocker rail 505. The distance measured between arm ports 622 and 623 is substantially shorter than the distance measured between the distal end of back-supporting arm 503 and the distal end of seat-supporting arm 501.

In some embodiments, rocker rails 505, 506 are comprised of wood, including by non-limiting example, beech, bamboo, pine, oak, maple, or other wood. In other embodiments, rocker rails 505, 506 may be made of a metal or a synthetic material, such as, for example, injection plastics. Metal rocker rails 505, 506 can be stamped, extruded, milled, forged, or bent. In yet other embodiments rocker rails 505, 506 are comprised of a combination of materials, including without limitation, any combination of wood, metal, and/or synthetic material. The rocker rails 505, 506 have a curved arc 730 along the bottom side for rocking front-to-back. In certain embodiments curved arc 730 transitions to a flat tail portion 735 on the underside of the rocker rails. Flat tail portion 735 helps prevent rocking chair from being rocked too far backwards.

Unless otherwise indicated, all numbers expressing of lengths, distances, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the exemplary embodiments (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. The use of any and all examples, or exemplary language (e.g., "such as") provided herein is intended merely to better illuminate the exemplary embodiments and does not pose a limitation on the scope of the exemplary embodiments otherwise claimed. No language in the specification should be construed as indicating any non-claimed element essential to the practice of the exemplary embodiments.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the inventors for carrying out the exemplary embodiments. Of course, variations on these described embodiments will become apparent to those of ordinary skill in the art upon reading the foregoing description. The inventors expect skilled artisans to employ such variations as appropriate, and the inventors intend for the embodiments to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Exemplary embodiments so claimed are inherently or expressly described and enabled herein.

In sum, the exemplary embodiments disclosed herein are illustrative of the principles of the present disclosure. Other modifications that may be employed are within the scope of the disclosure. Thus, by way of example, but not of limitation, alternative configurations of the present exemplary embodiments may be utilized in accordance with the teachings herein. Accordingly, the present exemplary embodiments are not limited to that precisely as shown and described.

We claim:

1. A rocking chair, comprising:

a plurality of chair arms, each chair arm having a proximal end and a distal end;

a seat, removably coupled to and supported by the distal end of each of the plurality of chair arms; and a rocker assembly comprising:

a first rocker rail;

a second rocker rail;

at least one cross bar coupled to the first rocker rail and the second rocker rail;

a plurality of arm ports, each arm port removably receiving the proximal end of a corresponding one of the plurality of chair arms;

a first hub coupled to the first rocker rail, the first hub comprising a first arm port and a second arm port of the plurality of arm ports; and a second hub coupled to the second rocker rail, the second hub comprising a third arm port and a fourth arm port of the plurality of arm ports, wherein the first hub and the second hub are coupled to the at least one cross bar.

2. The rocking chair according to claim 1, wherein the rocker assembly comprises two cross bars and wherein each of the first hub and the second hub further comprises two cross bar ports, each cross bar port removably receiving one end of a corresponding one of the two cross bars.

3. The rocking chair according to claim 1, wherein each chair arm comprises a plurality of hollow pole segments, said hollow pole segments removably coupled to each other and removably coupled to the first hub or the second hub via an elastic cord.

4. The rocking chair according to claim 3 wherein the elastic cord comprises a first end and a second end, wherein the first end of the elastic cord terminates at the distal end of the chair arm removably received in the first arm port of the first hub and second end of the elastic cord terminates at the distal end of the chair arm removably received in the second arm port of the first hub.

5. The rocking chair according to claim 1 wherein the at least one cross bar is coupled to the first rocker rail and the second rocker rail via an elastic cord.

6. The rocking chair according to claim 1 comprising four chair arms, wherein two chair arms are back-supporting arms and two chair arms are seat-supporting arms, and wherein a length of each of the two back-supporting arms is greater than a length of each of the two seat-supporting arms.

7. The rocking chair according to claim 6 wherein a distance between the distal ends of the back-supporting arms is less than a distance between the distal ends of the seat-supporting arms.

8. The rocking chair according to claim 6 wherein a distance between the distal end of a first back-supporting arm and the distal end of a first seat-supporting arm is greater than a distance between the proximal end of the first back-supporting arm and the proximal end of the first seat-supporting arm.

9. The rocking chair according to claim 6 wherein a length of the seat measured between a midpoint between the two back-supporting arms and a midpoint between the two seat-supporting arms is greater than a length of the seat measured between the distal end of a first back-supporting arm and the distal end of a first seat-supporting arm.

10. The rocking chair according to claim 1 wherein the seat comprises at least two fabric panels.

11. The rocking chair according to claim 1 wherein the seat comprises a plurality of pockets, each pocket removably receiving the distal end of a corresponding one of the plurality of chair arms.

12. The rocking chair according to claim 1 wherein each of the first rocker rail and the second rocker rail comprises a curved arc front portion and a flat tail portion.

13. The rocking chair according to claim 1, wherein the rocker assembly further comprises:

at least one threaded rod, each threaded rod located within and running a length of a corresponding one of the at least one cross bar and coupled to the first rocker rail and the second rocker rail; and at least one fastener in each of the first rocker rail and the second rocker rail, wherein each of the at least one fastener receives one end of a corresponding one of the at least one threaded rod.

14. A rocking chair, comprising:

a plurality of chair arms, each chair arm having a proximal end and a distal end;

a seat, removably coupled to and supported by the distal end of each of the plurality of chair arms; and a rocker assembly comprising:

a first rocker rail;

a second rocker rail;

at least one cross bar coupled to the first rocker rail and the second rocker rail; and a plurality of arm ports, each arm port removably receiving the proximal end of a corresponding one of the plurality of chair arms;

wherein each chair arm comprises:

at least one hollow pole segment, said at least one hollow pole segment removably coupled to the rocker assembly; and an elastic cord comprising a first end and a second end, wherein the elastic cord runs through the at least one hollow pole segment and the first end of the elastic cord terminates within one of the plurality of arm ports of the rocker assembly and second end of the elastic cord terminates at the distal end of the chair arm.

15. The rocking chair according to claim 14, wherein the rocker assembly further comprises:

a first hub coupled to the first rocker rail, the first hub comprising a first arm port and a second arm port of the plurality of arm ports; and a second hub coupled to the second rocker rail, the second hub comprising a third arm port and a fourth arm port of the plurality of arm ports.

16. The rocking chair according to claim 15, wherein the first hub and the second hub are coupled to the at least one cross bar.

17. The rocking chair according to claim 14 wherein said at least one hollow pole segment comprises a plurality of hollow pole segments, wherein the hollow pole segments are removably coupled to each other via the elastic cord.

18. A collapsible rocking chair system, comprising:

four chair arms, wherein two chair arms are back-supporting arms and two chair arms are seat-supporting arms of shorter length than the back-supporting arms, and wherein each chair arm has a proximal end and a distal end and comprises at least two hollow pole segments and an elastic cord, said pole segments couplable to one another via the elastic cord;

a hammock-shaped fabric seat comprising four pockets, wherein the seat is removably couplable to the distal ends of the chair arms and wherein the distal end of each chair arm is removably received into a corresponding one of the four pockets;

two rocker rails;

at least two cross bars; and two hubs, each hub coupled to a corresponding one of the two rocker rails and comprising:

a back-supporting arm port capable of removably receiving the proximal end of a corresponding one of the two back-supporting arms and comprising a termination point for one end of the elastic cord of the corresponding one of the two back-supporting arms;

a seat-supporting arm port capable of removably receiving the proximal end of a corresponding one of the two seat-supporting arms and comprising a termination point for one end of the elastic cord of the corresponding one of the two seat-supporting arms; and at least two cross bar ports, each cross bar port being adapted to receive an end of a corresponding one of the at least two cross bars.

19. The collapsible rocking chair system of claim 18, further comprising a tote bag having a shoulder strap or handle, wherein the four chair arms, the seat, the two rocker rails, the at least two cross bars, and the two hubs are contained in the tote bag.

* * * * *